US011197111B2

(12) United States Patent
de Ruijter et al.

(10) Patent No.: US 11,197,111 B2
(45) Date of Patent: Dec. 7, 2021

(54) REDUCED FEEDBACK IN VALVE-RIC ASSEMBLY

(71) Applicant: Sonion Nederland B.V., Hoofddorp (NL)

(72) Inventors: Laurens de Ruijter, Hoofddorp (NL); Alwin Fransen, Hoofddorp (NL); Raymond Mögelin, Hoofddorp (NL); Oleg Antoniuk, Hoofddorp (NL); Nicolaas Maria Jozef Stoffels, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 52 days.

(21) Appl. No.: 16/849,330

(22) Filed: Apr. 15, 2020

(65) Prior Publication Data

US 2020/0329321 A1 Oct. 15, 2020

(30) Foreign Application Priority Data

Apr. 15, 2019 (EP) ..... 19169292

(51) Int. Cl.
*H04R 25/00* (2006.01)

(52) U.S. Cl.
CPC ..... *H04R 25/65* (2013.01); *H04R 2225/025* (2013.01); *H04R 2460/11* (2013.01)

(58) Field of Classification Search
USPC ..... 381/328
See application file for complete search history.

(56) References Cited

U.S. PATENT DOCUMENTS

| | | | |
|---|---|---|---|
| 6,788,796 | B1 | 9/2004 | Miles |
| 6,819,770 | B2 | 11/2004 | Niederdrank |
| 6,831,577 | B1 | 12/2004 | Furst |
| 6,853,290 | B2 | 2/2005 | Jorgensen |
| 6,859,542 | B2 | 2/2005 | Johannsen |
| 6,888,408 | B2 | 5/2005 | Furst |
| 6,914,992 | B1 | 7/2005 | van Halteren |
| 6,919,519 | B2 | 7/2005 | Ravnkilde |
| 6,930,259 | B1 | 8/2005 | Jorgensen |
| 6,943,308 | B2 | 9/2005 | Ravnkilde |
| 6,974,921 | B2 | 12/2005 | Jorgensen |
| 7,008,271 | B2 | 3/2006 | Jorgensen |

(Continued)

FOREIGN PATENT DOCUMENTS

| | | |
|---|---|---|
| EP | 3342749 A2 | 7/2018 |
| EP | 3451688 A1 | 3/2019 |

(Continued)

OTHER PUBLICATIONS

Burkhard, M.D. and Sachs, R.M., "Sound Pressure in Insert Earphone Couplers and Real Ears," Journal of Speech and Hearing Research, vol. 20, pp. 799-807 (1977).

*Primary Examiner* — Phylesha Dabney
(74) *Attorney, Agent, or Firm* — Nixon Peabody LLP

(57) ABSTRACT

A personal hearing device with a first dome, a receiver, a speaker channel extending from the receiver through the dome to a speaker channel output, an acoustic vent channel extending from outside of the receiver and through the dome, where an acoustic separation is provided between the speaker channel output and the vent opening to reduce the amount of sound output by the receiver entering the vent channel.

16 Claims, 5 Drawing Sheets

(56) References Cited

U.S. PATENT DOCUMENTS

| | | | |
|---|---|---|---|
| 7,012,200 | B2 | 3/2006 | Moller |
| 7,062,058 | B2 | 6/2006 | Steeman |
| 7,062,063 | B2 | 6/2006 | Hansen |
| 7,072,482 | B2 | 7/2006 | Van Doorn |
| 7,088,839 | B2 | 8/2006 | Geschier |
| 7,110,560 | B2 | 9/2006 | Stenberg |
| 7,136,496 | B2 | 11/2006 | van Halteren |
| 7,142,682 | B2 | 11/2006 | Mullenborn |
| 7,181,035 | B2 | 2/2007 | van Halteren |
| 7,190,803 | B2 | 3/2007 | van Halteren |
| 7,206,428 | B2 | 4/2007 | Geschier |
| 7,221,767 | B2 | 5/2007 | Mullenborn |
| 7,221,769 | B1 | 5/2007 | Jorgensen |
| 7,227,968 | B2 | 6/2007 | van Halteren |
| 7,239,714 | B2 | 7/2007 | de Blok |
| 7,245,734 | B2 | 7/2007 | Niederdraenk |
| 7,254,248 | B2 | 8/2007 | Johannsen |
| 7,286,680 | B2 | 10/2007 | Steeman |
| 7,292,700 | B1 | 11/2007 | Engbert |
| 7,292,876 | B2 | 11/2007 | Bosh |
| 7,336,794 | B2 | 2/2008 | Furst |
| 7,376,240 | B2 | 5/2008 | Hansen |
| 7,403,630 | B2 | 7/2008 | Jorgensen |
| 7,415,121 | B2 | 8/2008 | Mögelin |
| 7,425,196 | B2 | 9/2008 | Jorgensen |
| 7,460,681 | B2 | 12/2008 | Geschiere |
| 7,466,835 | B2 | 12/2008 | Stenberg |
| 7,492,919 | B2 | 2/2009 | Engbert |
| 7,548,626 | B2 | 6/2009 | Stenberg |
| 7,657,048 | B2 | 2/2010 | van Halteren |
| 7,684,575 | B2 | 3/2010 | van Halteren |
| 7,706,561 | B2 | 4/2010 | Wilmink |
| 7,715,583 | B2 | 5/2010 | Van Halteren |
| 7,728,237 | B2 | 6/2010 | Pedersen |
| 7,747,032 | B2 | 6/2010 | Zei |
| 7,809,151 | B2 | 10/2010 | Van Halteren |
| 7,822,218 | B2 | 10/2010 | Van Halteren |
| 7,899,203 | B2 | 3/2011 | Van Halteren |
| 7,912,240 | B2 | 3/2011 | Madaffari |
| 7,946,890 | B1 | 5/2011 | Bondo |
| 7,953,241 | B2 | 5/2011 | Jorgensen |
| 7,961,899 | B2 | 6/2011 | Van Halteren |
| 7,970,161 | B2 | 6/2011 | van Halteren |
| 7,995,782 | B2 | 8/2011 | Saltykov |
| 8,098,854 | B2 | 1/2012 | van Halteren |
| 8,101,876 | B2 | 1/2012 | Andreasen |
| 8,103,039 | B2 | 1/2012 | van Halteren |
| 8,160,290 | B2 | 4/2012 | Jorgensen |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman |
| 8,233,652 | B2 | 7/2012 | Jorgensen |
| 8,259,963 | B2 | 9/2012 | Stenberg |
| 8,259,976 | B2 | 9/2012 | van Halteren |
| 8,259,977 | B2 | 9/2012 | Jorgensen |
| 8,280,082 | B2 | 10/2012 | van Halteren |
| 8,284,966 | B2 | 10/2012 | Wilk |
| 8,313,336 | B2 | 11/2012 | Bondo |
| 8,315,422 | B2 | 11/2012 | van Halteren |
| 8,331,595 | B2 | 12/2012 | van Halteren |
| 8,369,552 | B2 | 2/2013 | Engbert |
| 8,379,899 | B2 | 2/2013 | van Halteren |
| 8,509,468 | B2 | 8/2013 | van Halteren |
| 8,526,651 | B2 | 9/2013 | Lafort |
| 8,526,652 | B2 | 9/2013 | Ambrose |
| 9,654,854 | B2 | 5/2017 | Darlington |
| 2003/0081805 | A1* | 5/2003 | Fushimi ..... H04R 1/1016 381/325 |
| 2009/0123010 | A1 | 5/2009 | Cano |
| 2011/0182453 | A1 | 7/2011 | van Hal |
| 2011/0189880 | A1 | 8/2011 | Bondo |
| 2011/0274296 | A1* | 11/2011 | Wai ..... H04R 1/1016 381/121 |
| 2011/0299708 | A1 | 12/2011 | Bondo |
| 2011/0299712 | A1 | 12/2011 | Bondo |
| 2011/0311069 | A1 | 12/2011 | Ambrose |
| 2012/0014548 | A1 | 1/2012 | van Halteren |
| 2012/0027245 | A1 | 2/2012 | van Halteren |
| 2012/0140966 | A1 | 6/2012 | Mocking |
| 2012/0155683 | A1 | 6/2012 | van Halteren |
| 2012/0155694 | A1 | 6/2012 | Reeuwijk |
| 2012/0255805 | A1 | 10/2012 | van Halteren |
| 2013/0028451 | A1 | 1/2013 | de Roo |
| 2013/0136284 | A1 | 5/2013 | van Hal |
| 2013/0142370 | A1 | 6/2013 | Engbert |
| 2013/0163799 | A1 | 6/2013 | Van Halteren |
| 2013/0195295 | A1 | 8/2013 | van Halteren |
| 2015/0030196 | A1* | 1/2015 | Basseas ..... H04L 61/2514 381/380 |
| 2018/0041852 | A1 | 2/2018 | Karamuk |
| 2019/0253793 | A1* | 8/2019 | Pedersen ..... H04R 25/60 |
| 2020/0221206 | A1* | 7/2020 | Iseberg ..... H04R 1/1016 |
| 2020/0288251 | A1* | 9/2020 | Kuipers ..... H04R 1/2803 |
| 2021/0076145 | A1* | 3/2021 | Junke ..... H04R 25/65 |

FOREIGN PATENT DOCUMENTS

| | | | |
|---|---|---|---|
| EP | 3467457 | A2 | 4/2019 |
| EP | 3471432 | A1 | 4/2019 |
| EP | 3471433 | A2 | 4/2019 |
| EP | 3471437 | A1 | 4/2019 |

* cited by examiner

IN EAR CANALPHONES

REDUCED FEEDBACK IN VALVE-RIC ASSEMBLY

CROSS-REFERENCE TO RELATED APPLICATIONS

This application claims the benefit of European Patent Application Serial No. 19169292.0, filed Apr. 15, 2020, which is incorporated herein by reference in its entirety.

FIELD OF THE INVENTION

The present invention relates to a personal hearing device, such as a hearing aid, ear plug, earpiece, hearable or the like, and in particular a hearing device or a portion thereof for insertion in or at a person's ear canal.

BACKGROUND OF THE INVENTION

When an element acoustically blocks an ear canal, such as when a blocking dome is used for attaching the element in the ear canal, low frequency body-conducted sound may build up in the ear canal due to the so-called occlusion effect. Thus, often a vent channel is used for guiding such low frequency sound out of the ear canal and thus past the blocking element. This then acts to solve the occlusion effect but may bring about another problem in that also sound generated by a sound generator, often called a receiver, in this element may also find its way out of the vent channel. This may not be desired.

Vent channels and the like may be seen in U.S. Pat. Nos. 9,654,854, 7,995,782, 7,747,032, EP3451688, EP3471437, EP3471432 and EP3471433, which are hereby incorporated in their entirety by reference.

In a first aspect, the invention relates to a personal hearing device for positioning at or in an ear canal, the device comprising an outer housing, a first dome and a miniature speaker provided in the housing, where:

- a speaker channel is provided extending from the speaker to a speaker channel output, the speaker channel output being provided in or at one side of the first dome,
- an acoustic vent channel is provided from a vent channel opening in or at the one side of the first dome to outside of the housing,
- where the speaker channel output and the vent channel opening are positioned with a shortest distance between them, and outside of the hearing device, of 1-5 mm.

SUMMARY OF THE INVENTION

In the present context, a personal hearing device may be or form part of a hearing aid, a hearable or the like. At least the first dome is configured to be provided in or at an ear canal of a person. Thus, the first dome preferably is made of a resilient material, such as a polymer, rubber or the like. The first dome may include a solid material or a foam (open or closed) or an earmold, for example. The first dome may have an intended direction of insertion into the ear canal and a cross sectional area, in an unstressed state and in a plane perpendicular to this direction of 10-100 $mm^2$, such as 20-50 $mm^2$.

In the present context, the dome may be any type of element configured to maintain the hearing device in or at the ear. Domes often are mushroom shaped or umbrella shaped to fully span the ear canal while staying relatively soft and comfortable in the ear while still supporting or maintaining the outer housing in a relative position to the dome.

The one side of the first dome may be defined in such a way as to face towards entirely or partly inside the earcanal. The one side of the first dome may be a part of the first dome which is oriented such that the sound flows through the first dome into a volume fully or partially in a portion of the earcanal between the first dome and eardrum.

The first dome is often intended to be completely sound blocking so that all sound passing the dome passes channels formed in the dome. Domes exist, however, which have channels therein for allowing at least some sound to pass through the dome outside of the above channels formed therein. Then, the resiliency of the dome may act to both provide the attachment and/or positioning as well as the sealing required.

Usually, the dome has a first side intended to point toward the ear drum and another side, often an opposite side, to or at which the outer housing may be engaged or attached, for example, and/or in or at which the speaker channel and/or the vent channel exits the dome.

The speaker may be provided on another side of the first dome. The other side may be further away from the eardrum than the first side. For example, the speaker itself and the speaker channel output may be on opposite sides of the speaker channel. The speaker channel may be formed by any combination of a tube, nozzle, spout, sleeve, or other sound guiding means integrated or partially integrated or connected to the dome.

The acoustic vent channel may be provided from the vent channel opening in or at the one side of the first dome to the other side of the first dome and outside of the housing.

The first dome may be in an earpiece configured to position, attach or fix the housing inside or at the ear canal.

Often, it is desired to also have the housing and/or the speaker in the ear canal. Speakers for this use often are called miniature receivers and usually have a largest dimension, such as a longest receiver side, of no more than 24 mm, such as in the interval of 3-18 mm, such as 6 mm or less, such as 5 mm or less, such as 4 mm or less.

For housings to be positioned in an ear canal, a largest dimension often is 8-18 mm, whereas for positioning in an ear, the largest dimension often is no more than 24 mm. A relative long housing may be accepted, but the cross section in a plane perpendicular to the longitudinal direction of the housing should be limited in order to fit in the ear canal. This cross sectional area normally is smaller than that of the dome.

Naturally, the speaker, which is usually called a receiver in the hearing industry, may be based on any type of technology, such as balanced armature, moving coil, moving armature, piezo electric elements or the like.

The outer housing may be an outer housing of the receiver or an additional housing in which the receiver is at least partly received. Often, it is preferred to have an outer housing in which the receiver is provided and wherein also additional elements may be provided such as a battery or other power source, a microphone, a processor, a telecoil or other signal receiver, sensors such as a photoplethysmography-based (PPG) optical sensor, accelerometer, temperature sensor, voice pick up (VPU) sensor (for example as described in European patent application No. 19153514.5 or 17210331.9) or the like.

The speaker channel extends through the first dome and to the speaker which is provided at least partly at or the other side of the dome. The speaker may be provided partly inside the dome if desired, or the speaker may be provided outside of the dome.

The speaker channel may be formed at least partly by the dome material or may be formed by e.g. a separate element extending inside the dome.

The speaker channel has a speaker channel output provided in or at the one side of the dome which is intended to be directed toward the ear drum of the ear canal. As will be seen below, a large number of manners exist of providing such openings.

The acoustic vent channel is also provided in the dome from a vent channel opening at or in the first surface of the dome to the other side of the dome. The acoustic vent channel opens, at the other side of the dome, outside of the housing. Clearly, the acoustic vent channel may pass through the housing or may pass wholly outside of the housing. Preferably, sound exiting the vent channel will be able to travel to outside of the device and the ear of the person to truly escape from the ear. Thus, preferably, the device does not comprise elements which block the sound exiting the vent channel.

The vent channel may comprise a valve configured to open or close the vent channel in order to provide two different modes of operation. The open vent channel may act to allow low frequency sound to escape from the volume between the dome and the ear drum. A valve may be provided for preventing such escape. Valves are described in the above references which are incorporated in their entirety by reference thereto. A valve actuator (active electrically driven type of valve) may be located outside of (or partly inside) the acoustical vent channel, and a movable member of the valve actuator may be configured to open and close the valve channel in a translational, rotational, or another type of motion.

As is the case for the speaker channel, the vent channel may be formed by the dome material and/or by a separate element extending into or through the dome.

The separate element and the remainder of the dome may be made using a two component moulding where the channel may be made of a harder material to retain its space when the dome is positioned in e.g. an ear canal.

The speaker channel output and the vent channel opening are positioned with a shortest distance between them, and outside of the hearing device, of 1-5 mm. The shortest distance, in this respect, is outside of the hearing device, as sound clearly will not travel through the material of the device. Clearly, if the device has a channel between the openings, the sound will travel through the channel but will still be outside of the device.

The minimum distance is desired in order to reduce the amount of sound output by the speaker channel output and entering the vent channel opening. Below, a number of various manners of reducing this amount are described.

The minimum distance will normally be along an outer surface of the device from the edge of the sound channel output to the edge of the vent channel opening.

If the sound travels across a concavity, the sound will not travel along the surface thereof but directly across the concavity. On the other hand, sound will travel along the surface of a convexity.

In one embodiment, the vent channel has a length of 1-24 mm, an average cross section of 0.28-19.6 $mm^2$ and forming a low pass filter with a roll of frequency of at least 500 Hz.

Clearly, a roll off frequency of this type cannot be (see below) obtained by a long and very narrow sound passage. Preferably, the sound path has:

a length of 1-12 mm and a cross section of 0.28-10 $mm^2$
a length 12-24 mm and a cross section of 10-19.6 $mm^2$ or
a length of 8-16 mm and a cross section of 5-15 $mm^2$.

Preferably, the roll off frequency of the sound path is 200 Hz or more, such as 400 Hz or more, such as 600 Hz or more.

The length of the vent path may be a Euclidean distance between the two openings thereof, such as between centres of the openings. The length may alternatively be determined as a path which the sound takes between the two openings. If the sound is guided in a sound guide, such as a tube, the length of this guide/tube would define the length. If the sound is allowed to travel inside the housing between elements therein, such as receivers, microphones, electronics or the like, the path taken may be used for determining the length. In the situation where the sound takes multiple paths from the first to the second opening, the length may be the longest length, the shortest length, or a mean value of the lengths.

The length may be 1-24 mm, such as 5-24 mm, such as 18-24 mm, such as 20-24 mm, or 8-15 mm, such as 10-14 mm.

The cross section of the vent path also may be determined in a number of manners. Naturally, the sound path need not have a circular cross section along its entire length. Often, sound paths have portions, if not all of it, which do not have circular cross section. The acoustic properties, however, are not that much affected by the cross section of the sound path. Thus, the diameter of a portion of the sound path thus is a diameter defining an area (the corresponding circle) corresponding to, such as being identical to, a cross section of the sound path at that position. Naturally, the cross sectional area of the sound path may vary over the sound path, such as around the valve when in the open configuration.

The skilled person knows that in a sound tube with a predetermined inner diameter, an element with a lower inner diameter may not alter the acoustic properties too much, if the narrower diameter is for a short length only. Thus, it is preferred that the elements of the valve in the sound path are present within a maximum distance or length of 3 mm. Thus, preferably, the largest distance between any portions of the valve elements is 3 mm or less. This distance may be a Euclidian distance between the two portions of the valve elements or portions in the sound path. Alternatively, the distance may be a distance along the sound path, so that the sound encountering one extreme portion travels 3 mm or less, before it encounters the other extreme portion. Preferably, this length is even smaller, such as 2 mm or less, such as 1 mm or less. The smaller this distance is the lower is the impact of the narrowing on the acoustic properties defined by the remainder of the sound path.

In one situation:

the speaker channel output is provided within at least one first angle interval around a central axis of the first dome, and the vent channel opening is provided within at least one second angle interval around the central axis, the first and second angle intervals do not overlap.

In this context, the first angle interval may comprise a first number of angles and the second angle interval may comprise a second number of angles. No overlap will mean that no angle exists which is a first angle and a second angle or which is within both the first angle interval and the second angle interval.

Clearly, the output and the opening may be provided symmetrically around the axis, but this is by no means a requirement.

Often, when openings are provided at different positions of a dome-shaped element, the directions will be in different directions.

In one situation, as an example, the first and second angle interval are provided with at least 90 degrees between them, such as at least 100, 120, or at least 140 degrees between them. Preferably, the output and the opening are provided perpendicularly opposite each other.

In one embodiment, the speaker channel output defines a first output direction and wherein the vent channel opening defines a second direction, and wherein an angle of at least 5 degrees exist between the first and second directions.

In this connection, the direction of an output is less dependent on the direction of the channel ending in the output and more dependent on the opening and thus the edge(s) of the opening. If the edge of the opening is provided in a plane, the direction of the output would be perpendicular to this plane. If the edge has a more complex shape, the direction would be along a symmetry axis, for example, of this shape.

The angle between the two directions preferably is larger than 5 degrees, such as 10 degrees or more, such as 15 degrees or more, such as 20 degrees or more, such as 25 degrees or more, such as 30 degrees or more, such as 40 degrees or more, The intensity of the sound output from an opening is lower at higher angles to the direction of the output. Similarly, the intensity of sound entering an opening is lower at higher angles to the direction of the opening.

Preferably the directions are away from each other. Thus, a plane may exist between the opening and the output where the directions of the opening and the output are away from the plane.

Another manner of preventing sound from passing from the output to the opening is to make the path which the sound has to take more meandering. A more meandering path again will require the sound to go around corners. This will have the same overall effect that the larger the angle of the bend, the less sound actually negotiates the bend, as most of the sound will prefer to not deviate from its present direction.

In one situation, a shortest path, or even any path, outside of the device and from the speaker channel output to the vent channel opening, has one or more bends, where a total sum of angles of the bend(s) is at least 180 degrees, such as at least 200 degrees, such as at least 250 degrees, such as at least 300 degrees, such as at least 350 degrees, such as at least 400 degrees, such as at least 500 degrees.

In one embodiment, the device further comprises a separation member positioned at the one side of the first dome, the speaker channel output and the vent channel opening output being provided in the first dome or between the first dome and the separation member, the separation member covering the vent channel opening and the speaker channel output when projected on to a plane perpendicular to the central axis. This separation member may then operate as a wax protection member. In addition, the separation member may form a structure which the sound from the output has to travel around to reach the opening.

This separation member may be symmetric around a symmetry axis of the first dome. Then, the separation member may itself be dome shaped.

Alternatively, the separation member may comprise one or more leaf-shaped elements or be shaped as an oblong member, such as an oval member, so that it is able to cover both the opening and the output.

In one embodiment,

- a separation member is provided on the one side of the first dome, the speaker channel extending through the separation member,
- the vent channel opening is provided in the first dome or between the first dome and the separation member, and
- the separation member covers the vent channel opening when the separation member and the speaker channel opening are projected on to a plane perpendicular to a central axis of the first dome.

Naturally, the separation member may be symmetric around a symmetry axis of the first dome. Then, the separation member may itself be dome shaped.

In one situation, the speaker channel extends along the central axis. In this situation, the speaker channel output may be provided on a side of the separation member pointing away from the first dome. Then, the separation member again forms a structure which the sound has to travel around in order to reach the opening.

Then, the speaker channel may extend through a stem of the separation member or a portion extending from the first dome to the separation member fixing the separation member in relation to the dome.

Naturally, the separation member may be separate from the dome, or these elements may be attached to each other or even a monolithic unit. In one situation, the separation member may be attached to an element forming at least part of the speaker channel, so that the separation member is not directly attached to the dome.

In one situation, the device further comprises a protection member, the speaker channel opening being provided in the separation member or between the separation member and the protection member, the protection member covering the speaker channel opening when the protection member and the speaker channel opening are projected on to the plane. This protection member then may act to prevent wax from entering the speaker channel opening during introduction of the device into an ear canal.

In one embodiment, the separation member is circular symmetric around the central axis, as described.

In one embodiment, the device further comprises a valve configured to open and close the acoustic vent channel.

In one embodiment, the dome comprises a foam material. Foams exist which are transparent to sound, which makes the transport of sound easier. Such foam may alternatively be provided in or around the opening/output and/or in the channels in order to again prevent blocking by wax while allowing transport of the sound. The foam may include reticulated polyester or polyether polyurethane material. The foam material may have the porosity in the range 70-100 ppi (pores per inch), for example, 70, 75, 80, 85, 90 or 95 ppi.

Optionally, if no sound should flow through certain portions of an external surface of the foam, for example portions outside the opening/output and/or in the channels, these portions may be covered by an acoustic sealing coating, for example, flexible material such as a silicone which is commonly used for flexible acoustic domes in hearing aids or in earpieces or consumer earphones.

BRIEF DESCRIPTION OF THE DRAWINGS

In the following, preferred embodiments are described with reference to the drawings, wherein.

DETAILED DESCRIPTION OF THE INVENTION

Figure 1:
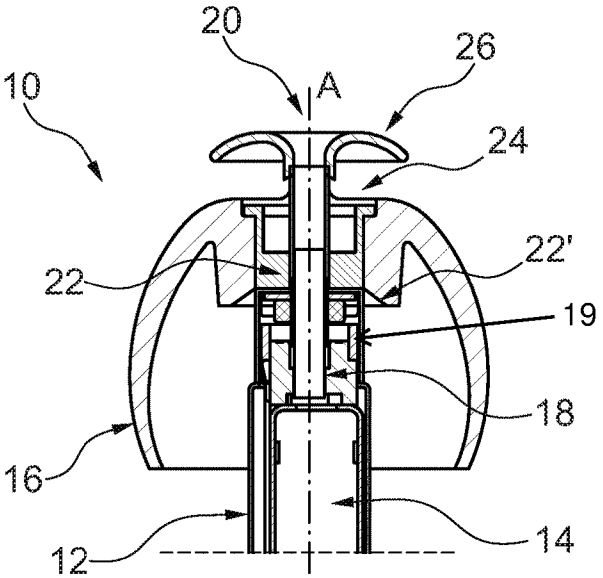
FIG. 1 illustrates a first embodiment of a personal hearing device with a central sound channel and a acoustic vent channel covered by a separation member.

In FIG. 1, a personal hearing device 10 is seen having a first dome 16, a receiver 14 provided in a housing 12 attached to the dome. The first dome is usually provided for attaching or fixing the device 10 inside an ear canal of a person. The first dome may be substantially sealing in the manner that sound and gas transport across the dome is impossible or at least impeded. Situations may exist where the first dome has a special channel, for example a small hole of any diameter in the range of 0.5-1 mm, therein (in a thin sealing wall of the dome, for example, a flexible flap of the dome) for allowing sound with a small intensity of air to travel from one side to the other side of the dome.

The upper side in the dome is to be directed toward the ear drum of the person. The speaker channel output 20 is provided in the upper portion and a speaker channel 18 exists between the receiver 14 (output) and the speaker channel output 20.

An acoustic vent channel 22 is provided having a vent channel opening 24. The acoustic vent channel 22 may extend to an opening 22' outside of the housing 14 on the lower side of the first dome. A vent of this type may have a valve configured to open and close the vent. This vent may be used for e.g. preventing the so-called occlusion effect.

A separation member 26 is provided. The sound channel 18 extends through the stem of the separation member to the speaker channel output which is provided on the upper side of the separation member.

The vent channel opening on the other hand is provided in the first dome or between the first dome and the separation member. It is seen that the separation member covers the vent channel opening when projected on to a plane perpendicular to the central axis A of the first dome. Often, the first dome, or at least an upper or outer surface thereof, will be symmetric, so that the central axis is a symmetry axis.

The function of the separation member thus is to reduce transfer of sound output by the speaker channel output 20 to the vent channel opening 24.

A purpose of the present device is to on the one side provide the vent 22 to allow low frequency sound to exit the space between the dome 16 in the ear canal (for venting air between the dome and eardrum to outside of earcanal, in order to reduce the occlusion) while, on the other side, to not have too much of the sound output by the speaker channel output escape the space between the speaker channel output and the ear drum through the vent 22 (to reduce the acoustical feedback). This is ensured, in this embodiment, by the separation member 26 increasing the distance, which sound must take between the speaker channel output and the vent channel opening, compared to the same set-up where the separation member is omitted. Preferably, the sound from the speaker channel output has to travel at least 1 mm in order to reach the vent channel opening.

In FIG. 1, the separation member 26 is dome-shaped. However, a number of other shapes may be used. The overall purpose of the separation member is to increase the distance which sound must take from the speaker channel output to the vent channel opening.

Clearly, the shortest path will extend over an along convexities but simply across concavities of the structure.

Another parameter which is operable to reduce the intensity of sound from the speaker channel output reaching the vent channel input is the angle which the sound must negotiate through this path, which influences the travelling distance of the sound, so that the distance may be increased by adjusting the angle.

Figure 8:
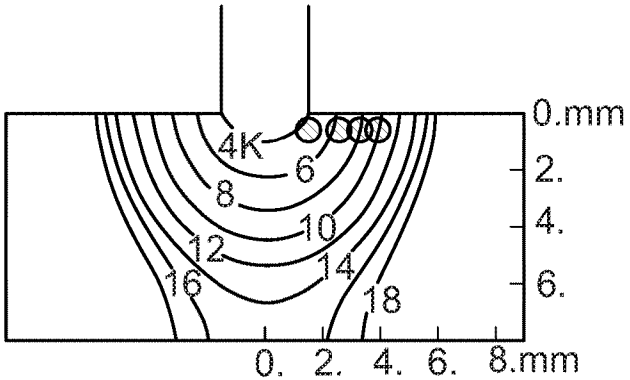
FIG. 8 illustrates surfaces of equal dip frequency at corresponding observation points inside a volume.

FIG. 8 is a figure from [M. D. Burkhard and R. M. Sachs, Sound Pressure in Insert Earphone Couplers and Real Ears, Journal of Speech and Hearing Research, vol. 20, pp 799-807 (1977)]: Surfaces of equal dip (antiresonance) frequency at corresponding observation points inside the volume of the 2CC simulator.

It is seen that sound emitted at 90 degrees to the sound output is attenuated within a much lower distance than sound output directly from the opening. Thus, the larger the angle which the sound must negotiate, the lower will the intensity be of the sound reaching the opening.

Figure 2:
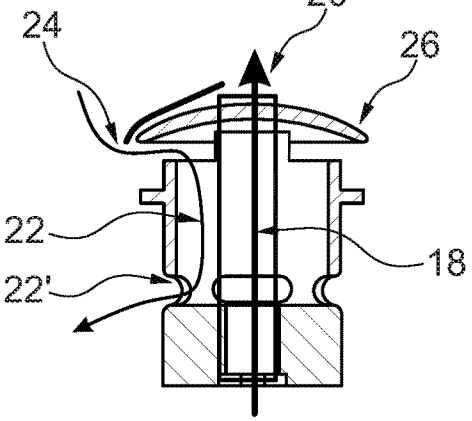
FIG. 2 illustrates the sound paths in the first embodiment.

In the embodiment of FIG. 2, it is seen that in addition to the actual distance to be covered by the sound, the sound has to firstly travel perpendicularly to the speaker channel opening and then turn 180 degrees, before it again turns 90 degrees to enter the vent channel opening. A total of 360 degrees thus is required for the sound to travel into the vent channel opening.

In this respect, the sound output of the opening is dependent on the angle of the sound relative to the opening—but not to the same degree to the direction of the sound passage leading to the opening.

In FIG. 1, the speaker channel output has an opening which is, in the drawing, horizontal. The main direction of sound output by an opening is a direction perpendicular to a plane defined by the opening, such as the outer edge(s) thereof, if such a plane exists.

Naturally, the sound entering the vent channel opening will see the same effect. The larger the angle from the opening angle, the less sound will actually enter the channel.

The complete angle which sound must negotiate between the speaker channel output and the vent channel opening thus is derived from that output direction and summed until the angle of the sound is along the direction of the vent channel opening.

In FIG. 1, a slidable element 19 is illustrated which may open and close the opening 22'. This slidable element 19 may then form a component of a valve assembly for opening and closing the acoustic vent channel, for example using an electromechanical actuator.

Figure 13:
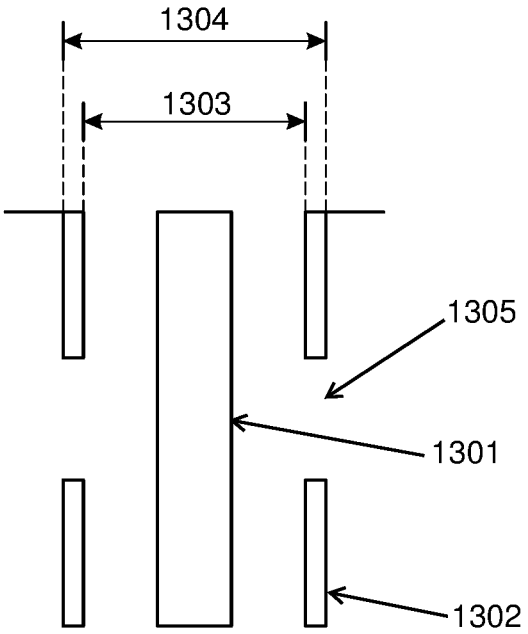
FIG. 13 illustrates an embodiment of a portion of the speaker channel and acoustic vent channel.

The speaker channel 18 may be partly formed by a relatively thin walled tube, such as a metal tube 1301 illustrated in FIG. 13 with a wall thickness of 10-60 μm, such as 25-35 μm, which still provides sufficient stiffness. The inner radius of this tube may be 1-3 mm, such as 1.5-2.4 mm.

The acoustic vent channel 22 may have a diameter of 2-4 mm, as it still should fit inside an ear canal. This channel 22 may also be formed by a tube e.g. 1302 in FIG. 13, which may be metal or a polymer having a wall thickness of 0.05-0.3 mm, such as around 0.1 mm. The inner radius 1303 of this tube may be 3.3 mm, or another value in the range 2.2-4 mm. The external radius 1304 of this tube may be 3.5 mm, or another value in the range 2.4-4.2 mm. A side venting opening 1305 may be provided, as described in EP 3471432.

Figure 12:
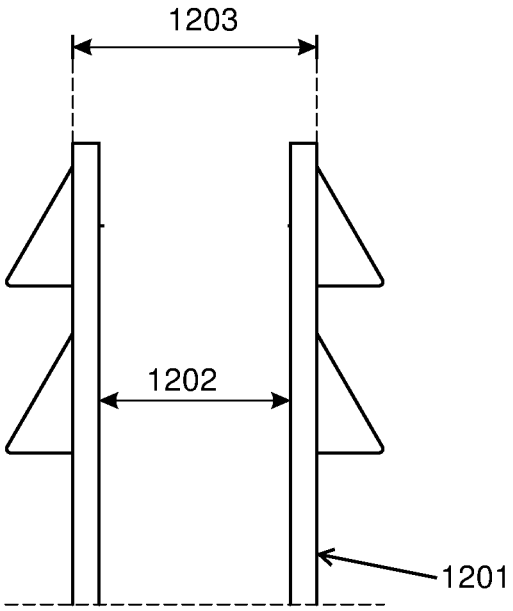
Fig. 12 prior art
FIG. 12 illustrates a section of a sound generator channel known from the prior art.

In FIG. 12, a speaker channel known from the prior art is illustrated. The tube 1202 forms a speaker channel with an inner radius 1202 of 1.4 mm, and external radius 1203 of 2.5 mm. The tube has plastic walls of 0.3 mm thickness.

FIG. 2 illustrates a device as that in FIG. 1 but where the first dome 16 and the receiver have been removed for clarity. The straight upward arrow illustrates the sound path of sound from the receiver 14 and the left, curved, downwardly directed arrow illustrates the sound path of the vent 22. The line above the dome 26 illustrates the path which sound from the sound outlet 20 must take to reach the vent channel opening 24.

Figure 3:
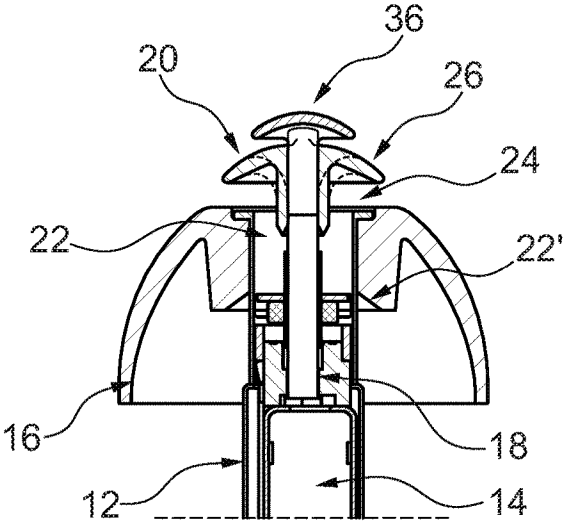
FIG. 3 illustrates an embodiment with a protection member for wax protection.

FIG. 3 illustrates an embodiment similar to that of FIG. 1. The same elements have the same reference numerals, and the difference is the presence of a preventing member, 36, which may also be dome shaped, which is provided above or over the speaker channel 18 to provide a wax protection. Then, the speaker channel outlet is now provided between the separation member 26 and the preventing member 36. The preventing member then may prevent ear wax from being forced into the speaker channel output when the device 10 is transported into the ear canal.

Figure 4:
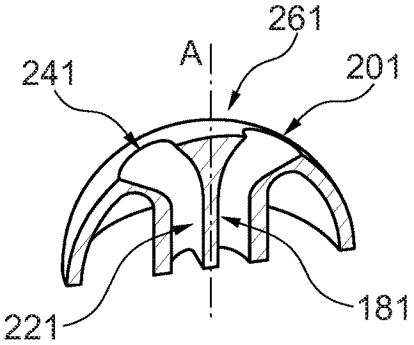
FIG. 4 illustrates a dome with a speaker channel and a vent channel.
Figure 4:
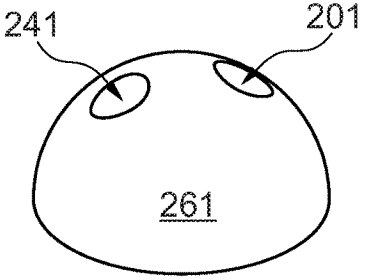

FIG. 4 illustrates an alternative embodiment with a first dome 261 having a speaker channel 181 with a speaker channel outlet 201 and a vent channel 221 with a vent channel opening 241. The receiver etc. is not illustrated.

Foam may be provided inside any of the speaker channel 18, acoustic vent channel 22, and/or the vent channel 221. The foam may include reticulated polyester or polyether polyurethane material. The foam material may have the porosity in the range 70-100 ppi (pores per inch), for example, 70, 75, 80, 85, 90 or 95 ppi. The foam may have a shape of a sleeve or tube or ring for positioning on a side of the tube 1302 in FIG. 13.

Figure 5:
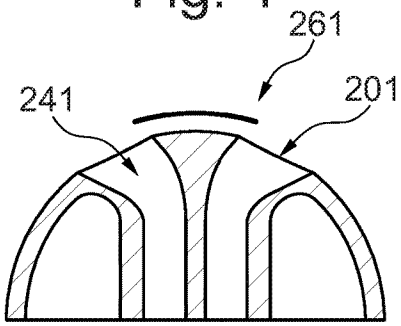
FIG. 5 illustrates the distance between the speaker channel output and the vent channel opening of the embodiment of FIG. 4.

Even though both channels extend through the stem of the dome, they flare out at the upper end to allow the output and the outlet to have a minimum distance, 261, illustrated in FIG. 5, between them. In addition, it is seen that the directions of the openings also are directed away from each other so that the angle which must be negotiated by the sound is more than a certain threshold value, such as 30, 40, 50, 60, 70, 80, 90, 100, 110, 120, 130, 140, 150, 160, 170, or 180 degrees.

In the present embodiment, the opening and output are provided symmetrically around the central axis A. This is not a requirement.

Figure 6:
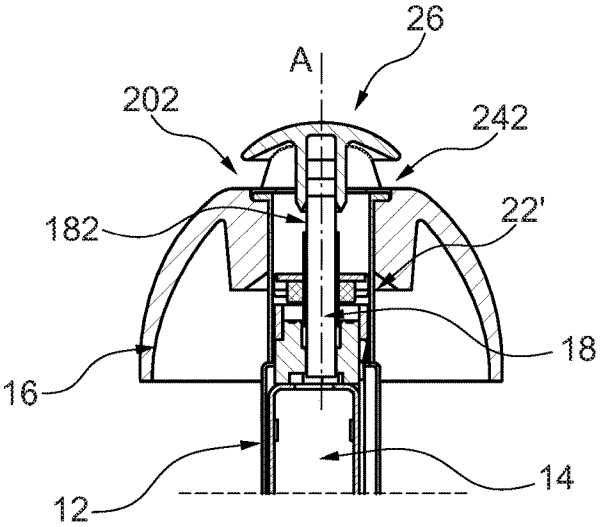
FIG. 6 illustrates yet an embodiment with the speaker channel output and the vent channel opening are directed in different directions but below a separation member.

In FIG. 6, yet another embodiment is illustrated where the features in common with FIG. 1 have the same numerals.

In the embodiment of FIG. 6, the sound channel 18 extends into a portion of the dome 16 via an opening 182 in the central sound channel. The speaker channel output 202 is provided below the separation member 26 which, in this situation, does not have a central speaker channel output.

In the same manner, the vent channel extends from an opening 22' below the dome 16 to the vent channel opening 242. The vent channel is not illustrated in the present cross section but exists in other cross sections.

Figure 7:
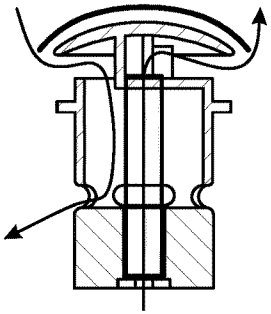
FIG. 7 illustrates the distance between the speaker channel output and the vent channel opening in the embodiment of FIG. 6.

The speaker channel output path and the vent path are seen in FIG. 7 as well as the shortest path which the sound must take from the speaker channel output to the vent channel opening.

Figure 9:
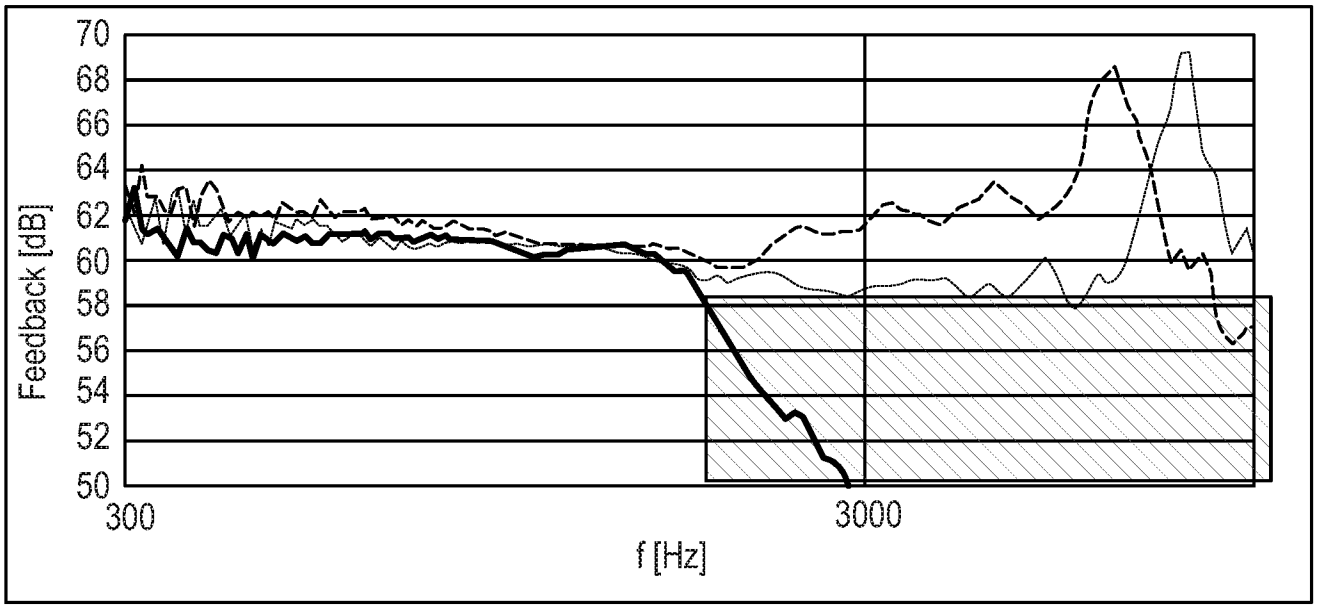
FIG. 9 illustrates effect of different spacing of speaker and vent channels on feedback reduction.

In FIG. 9, it is illustrated that a medium spacing with a shortest distance between a speaker channel output and the acoustic vent channel opening provides a certain feedback reduction. The large spacing provides another feedback reduction. In an exemplary test measurement, a microphone signal is measured outside the earcanal, for example as by a typical BTE microphone. Another acoustic signal is measured by a second microphone near the eardrum. In a first test, a closed dome is provided with a very small distance between the speaker channel output and the vent channel opening. At a certain frequency, e.g. 3 kHz, the difference between signals of both microphones approaches 50 dB difference. The possible gain margin of the hearing aid will be reduced and will not function properly. With the medium and large distances between the speaker channel output and the vent channel opening, the BTE microphone can still measure external audio signals and the hearing device functions properly.

Figure 10:
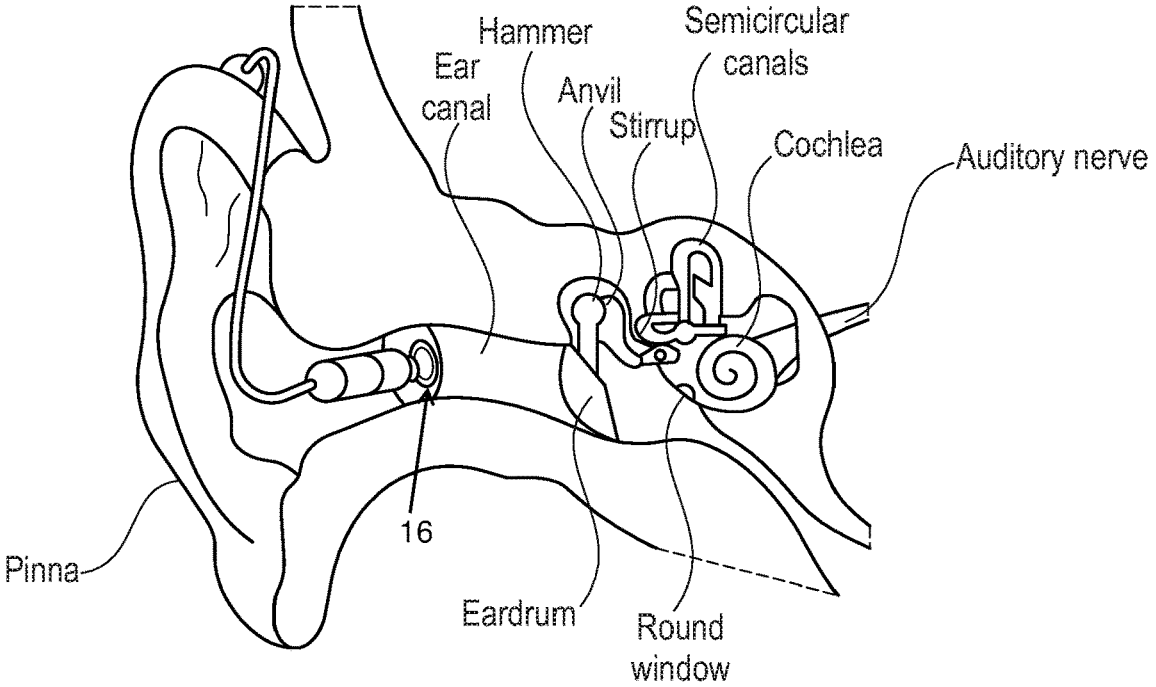
FIG. 10 illustrates an embodiment of a personal hearing device fully positioned in an earcanal.
Figure 11:
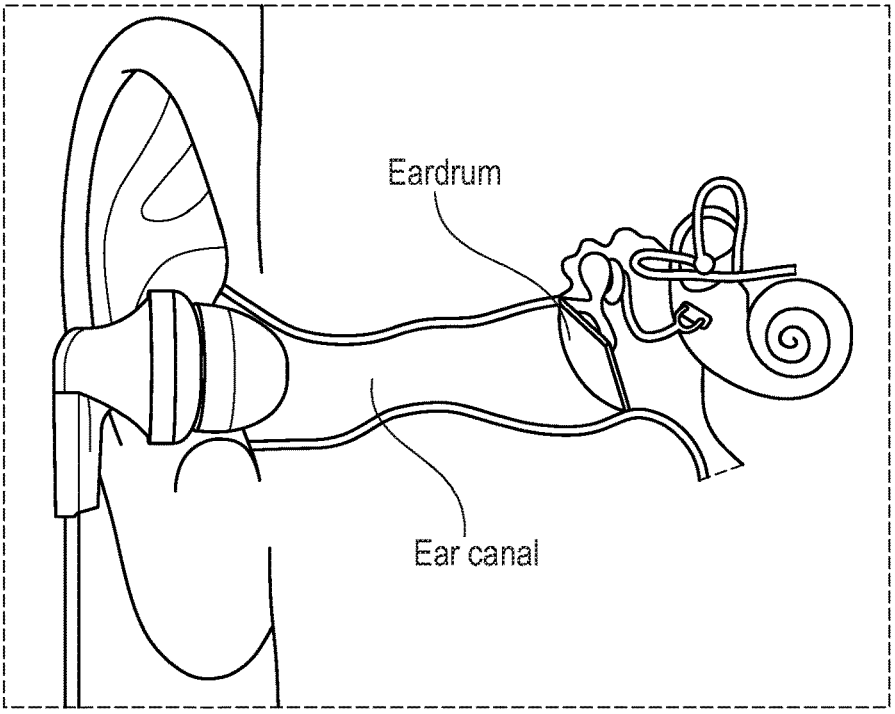
FIG. 11 illustrates an embodiment of a personal hearing device positioned at an earcanal.

FIG. 10 illustrates an embodiment of a personal hearing device fully positioned in an earcanal. A volume can be seen between the dome 16 and the eardrum. The speaker provides the sound to this volume. The vent releases the air from this volume to reduce the occlusion, while the vent channel opening and the speaker channel output are separated and interface this volume. In FIG. 11, a personal hearing device is positioned at an earcanal. A similar volume can be seen as with reference to FIG. 10.

According, to the invention a personal hearing device is provided for positioning at or in an ear canal, the device comprising an outer housing, a first dome and a speaker provided in the housing, where:

- a speaker channel is provided extending from the speaker to a speaker channel output, the speaker channel output being provided in or at one side of the first dome,
- an acoustic vent channel is provided from a vent channel opening in or at the one side of the first dome to outside of the housing,
- where the speaker channel output and the vent channel opening are separated through an acoustical separation arrangement to reduce the acoustical feedback.

Figure 14:
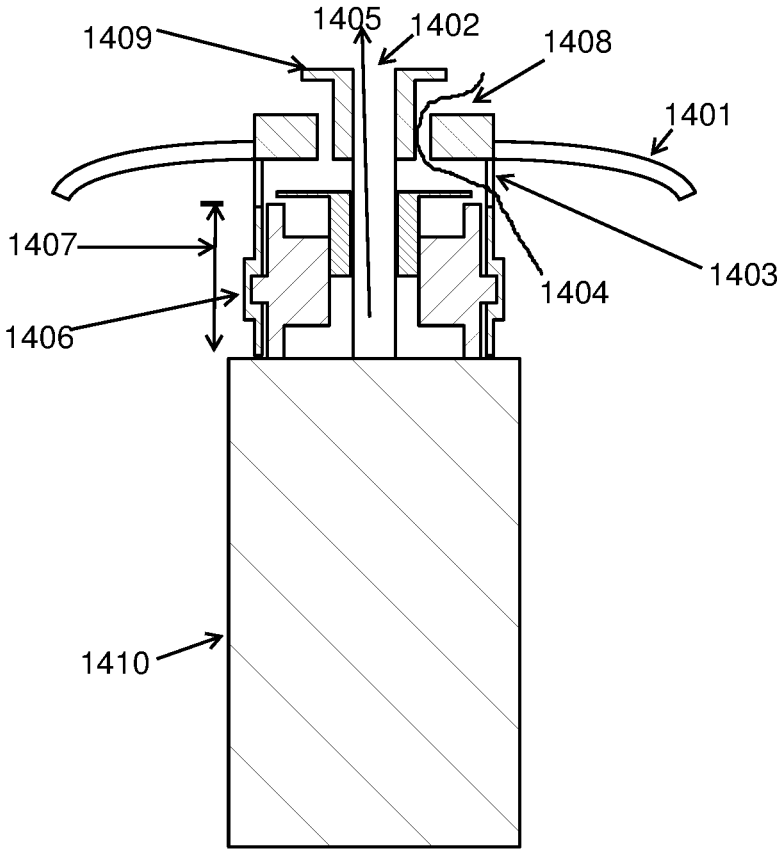
FIG. 14 illustrates a personal hearing device with a dome with an acoustic vent channel opening under a flap of the dome.

FIG. 14 illustrates a personal hearing device with a dome with an acoustic vent channel opening under a flap of the dome. The speaker outputs the sound through the speaker channel 1405, with the speaker channel output 1402. The dome has a flexible member 1401 for comfortably positioning a hearing device inside or at the earcanal. The acoustical venting channel 1404 is provided, with the opening 1408 just outside the dome and toward the earcanal, and with another opening 1403 under the dome flap 1401. The channels 1404 and 1405 are acoustically isolated from each other. The separation 1409 between the speaker channel output 1402 and the venting channel opening 1408 should be observed according to the present invention in order to reduce the feedback. The separation 1409 can be provided through the distance, angle or other solutions according to above embodiments.

The speaker channel and the venting channels may be also oriented sidewise as FIGS. 6 and 7.

Advantageously, a path length of the venting channel 1404 should be as short as possible, in order to improve the acoustical venting performance, for example, the shorter and wider the venting channel provides a better acoustic bandwidth, as described in European patent application number EP 17196716.9 and European patent application published as EP3471432. In order to provide a dome with such venting solution, the vent opening 1403 is provided as close to the dome flap 1401 as possible.

The dome may be mounted through a sleeve, plastic tube or in another way in a position 1407 between the venting opening 1403 and the rest of the hearing device, e.g. between the opening 1403 and the speaker housing 1410. In FIG. 14, it is illustrated that the dome is retained through a locking mechanism between the dome tube and the venting tube, for example, through a snap lock 1406.

The locking mechanism may require a hard material, while the dome flap 1401 may be made from a softer material as a softer "umbrella" for a user comfort. Such dome may be made using a 2 k molding. Such dome may be comfortable to a wearer, while also having a good retention on the hearing device. This also allows to position retention ribs 1406 further away from the flap 1401, while the venting opening 1403 is positioned closer the dome flap 1401.

The venting opening 1403 may be made by circular venting openings, e.g. as elements 22-1 in FIG. 17 of European patent application published as EP3471432.

Different structural elements of the receiver channel and venting channel may be combined and molded from the same material as the dome tube and stem.

The invention claimed is:

1. A personal hearing device for positioning at or in an ear canal, the device comprising an outer housing, a first dome and a speaker provided in the housing, where:

a speaker channel is provided extending from the speaker to a speaker channel output, the speaker channel output being provided in or at one side of the first dome, an acoustic vent channel is provided from a vent channel opening in or at the one side of the first dome to outside of the housing, where the speaker channel output and the vent channel opening are positioned with a shortest distance between them, and outside of the hearing device, of 1-5 mm.

2. A personal hearing device according to claim 1, where the vent channel has a length of 1-24 mm, an average cross section of 0.28-19.6 mm2 and forming a low pass filter with a roll of frequency of at least 500 Hz.

3. A personal hearing device according to claim 1 wherein the speaker channel output is provided within at least one first angle interval around a central axis of the first dome, and the vent channel opening is provided within at least one second angle interval around the central axis, the first and second angle intervals do not overlap.

4. A personal hearing device according to claim 3, wherein the first and second angle interval are provided with at least 90 degrees between them.

5. A personal hearing device according to claim 1, wherein the speaker channel output defines a first output direction and wherein the vent channel opening defines a second direction, and wherein an angle of at least 5 degrees exist between the first and second directions.

6. A personal hearing device according to claim 1, wherein a shortest path, outside of the device and from the speaker channel output to the vent channel opening, has one or more bends, where a total sum of angles of the bend(s) is at least 180 degrees.

7. A personal hearing device according to claim 1, further comprising a separation member positioned at the one side of the first dome, the speaker channel output and the vent channel opening output being provided in the first dome or between the first dome and the separation member, the separation member covering the speaker channel output and the vent channel opening when projected on to a plane perpendicular to a central axis of the dome.

8. A personal hearing device according to claim 1, wherein:

a separation member is provided on the one side of the first dome, the speaker channel extending through the separation member, the vent channel opening is provided in the first dome or between the first dome and the separation member, and the separation member covers the vent channel opening when the separation member and the speaker channel opening are projected on to a plane perpendicular to a central axis of the first dome.

9. A personal hearing device according to claim 8, wherein the speaker channel extends along the central axis.

10. A personal hearing device according to claim 8, wherein the speaker channel extends through a stem of the separation member.

11. A personal hearing device according claim 8, further comprising a protection member, the speaker channel opening being provided in the separation member or between the separation member and the protection member, the protection member covering the speaker channel opening when the protection member and the speaker channel opening are projected on to the plane.

12. A personal hearing device according to claim 8, wherein the separation member is circular symmetric around the central axis.

13. A personal hearing device according to claim 1, further comprising a valve assembly with an electromechanical actuator configured to open and close the acoustic vent channel.

14. A personal hearing device for positioning at or in an ear canal, the device comprising an outer housing, a first dome and a speaker provided in the housing, where:

a speaker channel is provided extending from the speaker to a speaker channel output, the speaker channel output being provided in or at one side of the first dome, an acoustic vent channel is provided from a vent channel opening in or at the one side of the first dome to outside of the housing, where the speaker channel output and the vent channel opening are separated through an acoustical separation arrangement to reduce the acoustical feedback, and wherein the venting channel has a second side opening under a flap of the dome for venting the sound to outside the hearing device.

15. A personal hearing device according to claim 14, further comprising an acoustically transparent foam in or at the speaker channel and/or the acoustical venting channel.

16. A personal hearing device according to claim 1, further comprising an acoustically transparent foam in or at the speaker channel and/or the acoustical venting channel.

* * * * *